United States Patent [19]

Hsu

[11] 4,121,995

[45] Oct. 24, 1978

[54] SURFACTANT-ASSISTED LIQUEFACTION OF PARTICULATE CARBONACEOUS SUBSTANCES

[75] Inventor: George C. Hsu, La Crescenta, Calif.

[73] Assignee: The United States of America as represented by the Administrator of the National Aeronautics and Space Administration, Washington, D.C.

[21] Appl. No.: 730,468

[22] Filed: Oct. 7, 1976

[51] Int. Cl.[2] ..... C10G 1/04; C10G 1/08; C10L 1/32; B65G 53/04

[52] U.S. Cl. ..... 208/8; 208/10; 44/51; 302/66

[58] Field of Search ..... 208/8, 10; 44/51; 302/66

[56] References Cited

U.S. PATENT DOCUMENTS

| | | | |
|---|---|---|---|
| 1,390,230 | 9/1921 | Bates | 44/51 |
| 1,390,232 | 9/1921 | Bates | 44/51 |
| 1,390,233 | 9/1921 | Bates | 44/51 |
| 1,431,225 | 10/1922 | Greenstreet | 44/51 |
| 1,684,125 | 9/1928 | Burnell | 44/51 |
| 1,881,691 | 10/1932 | Krauch | 208/8 |
| 1,925,551 | 9/1933 | Wietzel | 208/8 |
| 1,936,819 | 11/1933 | Bayer | 208/10 |
| 2,029,895 | 2/1936 | Rittmeister | 208/10 |
| 3,539,406 | 11/1970 | Lissant | 44/51 |
| 3,617,095 | 11/1971 | Lissant | 44/51 |
| 3,893,945 | 7/1975 | Willard, Sr. | 208/8 |
| 3,907,134 | 9/1975 | Metzger | 302/66 |
| 4,030,894 | 6/1977 | Marlin et al. | 44/51 |
| 4,069,022 | 1/1978 | Metzger | 44/51 |

FOREIGN PATENT DOCUMENTS

| | | | |
|---|---|---|---|
| 469,914 | 8/1937 | United Kingdom | 208/8 |

*Primary Examiner*—Delbert E. Gantz
*Assistant Examiner*—Joan Thierstein
*Attorney, Agent, or Firm*—Monte F. Mott; John R. Manning; Wilfred Grifka

[57] ABSTRACT

A slurry of carbonaceous particles such as coal containing an oil soluble polar substituted oleophilic surfactant, suitably an amine substituted long chain hydrocarbon, is liquefied at high temperature and high hydrogen presence. The pressure of surfactant results in an increase in yield and the conversion product contains a higher proportion of light and heavy oils and less asphaltene than products from other liquefaction processes.

14 Claims, 6 Drawing Figures

SURFACTANT-ASSISTED LIQUEFACTION OF PARTICULATE CARBONACEOUS SUBSTANCES

ORIGIN OF THE INVENTION

The invention described herein was made in the performance of work under a NASA contract and is subject to the provisions of Section 305 of the National Aeronautics and Space Act of 1958, Public Law 83-568 (72 Stat. 435; 42 USC 2457).

BACKGROUND OF THE INVENTION

1. Field of the Invention

The present invention relates to liquefaction of carbonaceous substances and more particularly to an improved process for liquefaction of coal.

2. Description of the Prior Art

The U.S. reserve of coal is about 3 trillion tons. Although the most abundant (80%) fossil fuel in America is coal, the U.S. consumption pattern is quite a reversal of form in terms of utilization, with coal representing only 17%, oil and gas about 78%.

The demand for all the fossil fuels combined is expected to double by the year 2000, even with increasing the use of nuclear power. While the domestic supply of crude oil and natural gas is not likely to keep pace with the energy demand, coal can play an important role in filling such a gap and thus reduce the requirements for imported supplies of oil and gas.

At the present time, about one-half of the electric power in the United States is generated from natural gas and petroleum; most of the other half is from coal. If coal can be economically converted to clean fuel for electric utilities, it could supply most of the energy needs of the United States for the next three centuries and the rapidly depleting petroleum and natural gas resources could be conserved for other essential uses, especially as a raw material for the synthetic rubber and plastics industries. Liquefied coal can also supply chemical intermediates and useful raw materials for these industries.

The methods used to liquefy coal are expensive and complex. There are other plentiful organic carbonaceous substances not presently being utilized such as cellulose waste, e.g., black liquor, heavy petroleum based materials, or sludge from waste treatment that are not presently being processed into hydrocarbon oils since efficient conversion processes have not been developed.

SUMMARY OF THE INVENTION

A liquefaction process has been discovered in accordance with this invention that provides increased total yield from about 40% to 50% to about 70% to 80% and provides increased yield of liquid oil fractions. Conversion yields comparable to prior art processes can be achieved at lower temperature and pressure and with lower hydrogen consumption in the process of the invention.

The commercial process for liquefaction of coal at high temperature and hydrogen pressure proceeds by forming a partially hydrogenated asphaltene intermediate as a colloidal particle suspension. Due to attached polar functional groups asphaltene particles generally exhibit polar characteristics. As a result of polar interactions such as hydrogen bonding, the asphaltene particles tend to aggregate or agglomerate into larger particles. This reduces surface area for hydrogenation and is a major cause of the requirement for high energy cost in terms of high temperature and pressure and hydrogen cost needed to break the particles into smaller fragments more easily accessible to hydrogen and solvent in order to achieve even 50% yields. Furthermore, the solubilities of polar aggregated asphaltene micelles is probably low in the presence of a non-polar solvent reaction media.

The enhanced and improved quality yields are achieved in accordance with this invention by adding to the coal slurry in solvent a small amount of an oil soluble organic surfactant capable of dispersing the asphaltene particles, and preferably a surfactant having an oleophilic chain to which is attached a polar group.

The surfactant prevents agglomeration and affects process kinetics and yield. It is believed that the polar end portion of each surfactant molecule associates with the polar group on the surface of the asphaltene particle and projects the oleophilic end portion to the outside. As a result, a plurality of surfactant molecules eventually form an oleophilic sheath around each particle which is compatible with the oleophilic solvent, thereby increasing solubility and preventing agglomeration. The dissolved hydrogen can readily penetrate this sheath to form oleophilic conversion products that enter the solvent media.

This and many other features and attendant advantages of the invention will become apparent as the invention becomes better understood by reference to the following detailed description when considered in conjunction with the accompanying drawings.

DESCRIPTION OF THE PREFERRED EMBODIMENTS

Figure 1:
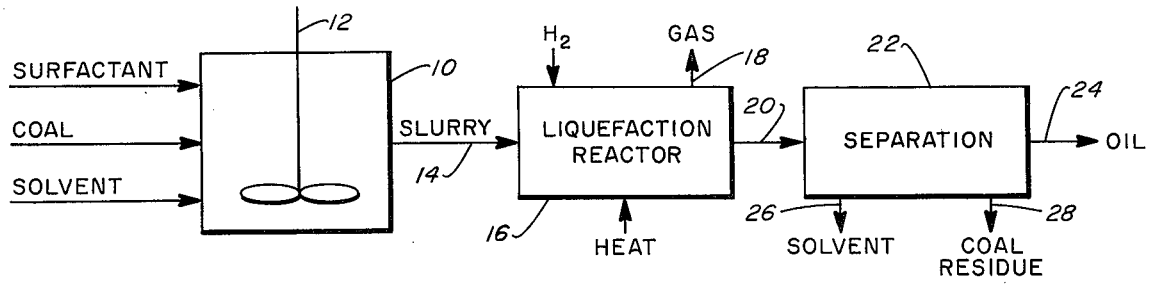
FIG. 1 is a schematic view of a surfactant-assisted coal liquefaction process in accordance with this invention.

Referring now to FIG. 1 the liquefaction system of the invention generally includes a slurrying means 10 having a stirrer 12 in which is formed a slurry of surfactant, particulate coal or other carbonaceous substance and solvent. The slurry 14 is converted in liquefaction reactor 16 under the influence of heat and high pressure hydrogen to a gaseous hydrocarbon product 18 and a product slurry which is then separated in separator 22 into a light and heavy oil product 24 solvent 26 and coal residue 28 by process steps including extraction, filtration and distillation. The conversion process proceeds through two kinetic steps, a first step in which the coal particles are converted to a slurry containing asphaltene particles plus solvent, solutes, ash, etc. After further hydrogenation the asphaltene products are converted to liquid oil, gas, char and insoluble residue due to polymerization. The decomposition step in which the particulate coal is converted to asphaltene is in general much faster than the transformation step in which the alphaltene is converted to the liquid oil product. The process of the invention may also be conducted in the presence of a catalyst such as cobalt molybdate, to increase the rate of asphaltene conversion to liquid oil in the transformation step.

Figure 2:
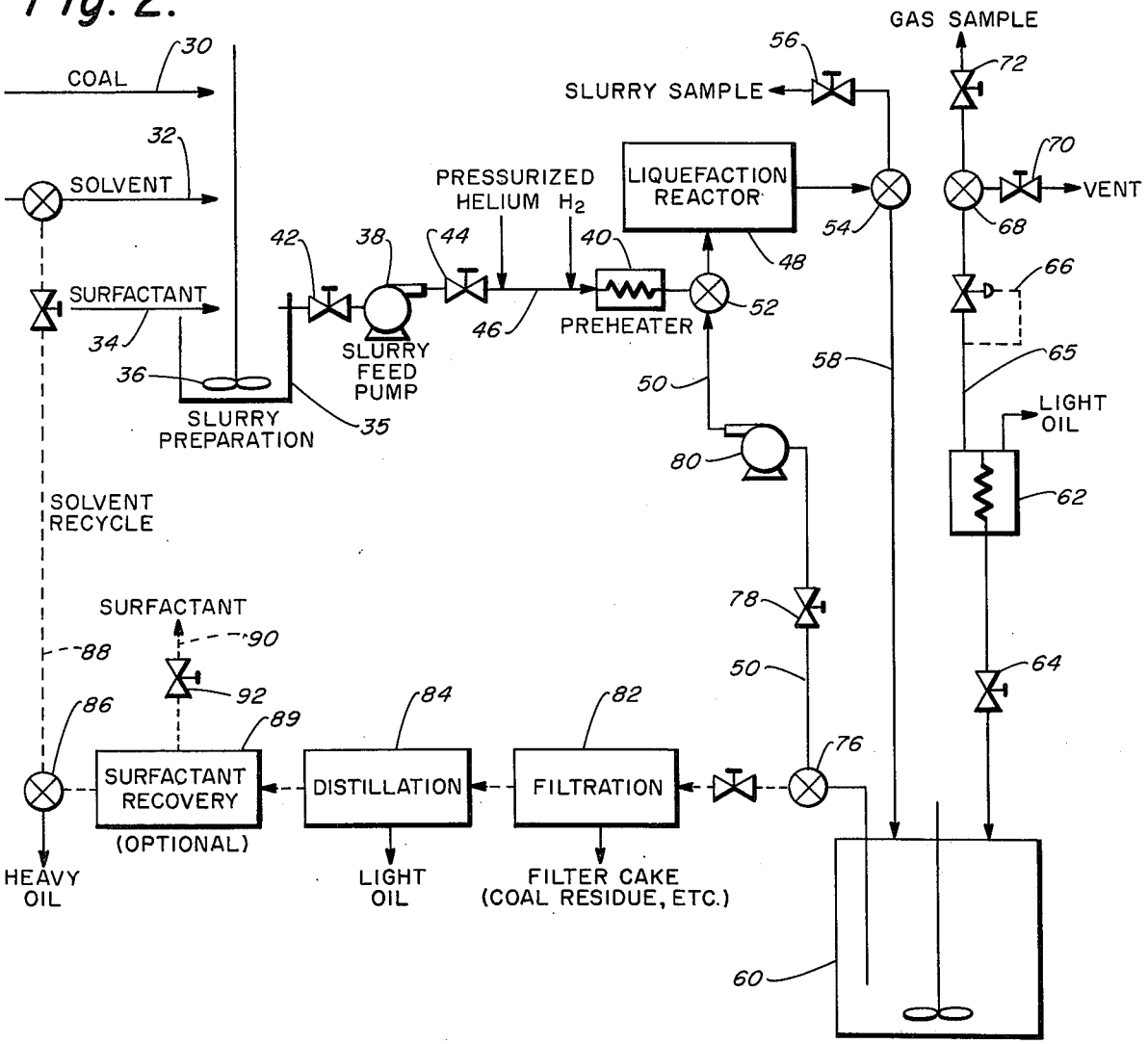
FIG. 2 is a flow diagrammatic view of a continuous surfactant-assisted liquefaction system.

A more complete continuous process is illustrated in FIG. 2 in which solid lines connote continuous operation and the discontinuous lines connote non-continuous operation. Pulverized coal from line 30 make up solvent from line 32 and surfactant from line 34 are added to slurry preparation tank 35 containing mixer 36. The solvent and surfactants are added in amount sufficient to take into consideration those amounts recycled from the process. The slurry is fed by pump 38 into preheater 40 when valves 42 and 44 are opened. The slurry may be pressurized in line 46 by adding helium and hydrogen into this line. The pressurizing gas in the reactor 48 need not totally comprise hydrogen but need only include a partial pressure of hydrogen sufficient to provide an excess of hydrogen for participating in the conversion reaction. The preheated slurry and recycle slurry from line 50 are fed by means of a 2-way inlet valve 52 into the liquefaction reactor 48 which is further pressurized with hydrogen through line 51. The slurries are maintained in the liquefaction reactor for a time sufficient for optimum conversion and are then removed through an outlet valve 54 to which may be attached a slurry sample valve 56 and a product recovery line 58 which delivers the product to pressurized receiver 60.

In continuous operation a light oil is recovered from cooler 62 when valve 64 is opened and a gas sample is recovered from line 65 containing back pressure regulator 66 and a two-way valve 68 connecting either to vent 70, or sample valve 72. The remaining slurry containing coal residue, solvent, surfactant and heavy oil is recycled through line 50 containing two-way outlet valve 76, valve 78 and pump 80 to inlet valve 52 to the liquefaction reactor 48.

In discontinuous operation the slurry product is separated in filtration unit 82 into a filter cake coal residue and a filtrate which is distilled in distillation unit 84 into a light oil product distillate and a bottoms containing surfactant heavy oil and solvent from which the heavy oil is recovered through valve 86. The solvent containing surfactant may be recycled through line 88 to solvent inlet 32. The surfactant may optionally be recovered in unit 89 by extraction and delivered through line 90 when valve 92 is open to the surfactant inlet line 34.

The process of the invention is capable of converting various types of organic materials in addition to coal such as heavy petroleum fractions, oil shale, municipal wastes or sludge or industrial wastes, particularly black liquor residues from sulfate or sulfite pulping. The coal feed can be anthracite, bituminous, sub-bituminous and lignite, one of the most abundant coal materials in the Western United States. Pulverization aids slurrying and conversion. Typically, the coal will be pulverized and classified to 60 to 325 mesh, usually to 100 from 200 mesh.

The organic solvent should be compatible with the carbonaceous material, conversion products and the surfactant. A preferred solvent is a coal derivative such as anthracene oil which is a mixed aliphatic and aromatic solvent, readily commercially available. The ratio of coal to solvent for effective operation is typically between 5% to 50%, preferably between 10% to 35%. The temperature of the liquefaction unit must be above 300° C. for effective conversion, typically from 325° C. to 500° C. The pressure in the unit should be above 500 psi up to 5000 psi or more typically 2000 to 4000 psi. As previously discussed part of the pressurizing gas may be an inert gas such as helium. The surfactant is present in an effective amount from 0.1 to 10% by weight based on dry coal solids typically from 0.5 to 5% by weight.

The surfactant is an oil soluble material having the capability of dispersing the asphaltene particles. There are many commercial oil soluble surfactants that are capable of dispersing sludge or oil suspended solids. Preferred surfactants in accordance with the invention are organic high molecular weight molecules having a large hydrophobic moiety and containing a minor portion of a polar group such as amine, hydroxyl, carboxyl, sulfonic, phosphonic, thiophosphate and the like. These surfactants generally have a molecular weight from 300 to 5000 generally from 600 to 3000 and contain from 1 to 15% by weight of polar substituents. An exemplary material is Polyflo-100 (Universal Oil Products) which is an oil-soluble, liquid dispersant-stabilizer used in the petroleum industry to prevent sludge formation during fuel storage. This surfactant is a long chain hydrocarbon alkyl amine type polymer with a predominant molecular weight around 2200 as identified by gel permeation chromatography. The hydrocarbon backbone of the polymer contains primary and secondary amine groups as well as hydroxyl groups with an average nitrogen content of 2.2% by weight and an oxygen content of 1.4 weight percent. Based on analytical results it is presumed that this material is made by cyanoethylation of a commercial hydroxyl-terminated hydrocarbon prepolymer with excess acrylonitrite. Part of the resulting primary amine groups are further reacted to form secondary amines.

Examples of practice follow.

A. Liquefaction Reaction

1. Apparatus

A 2-liter high pressure autoclave reactor (Parr Instrument 4542), equipped with a temperature controller and stirring regulator, was modified for coal liquefaction experiments.

2. Conditions

Coal type: North Dakota Zap Lignite

Coal size: 150 mesh minus

Solvent: Anthracene oil (Coal tar distillate) from Koppers Company

Solid Content in the slurry: 10 to 20% by weight

Surfactant: Polyflo-100 manufactured by Universal Oil Products

Surfactant Concentration tested: 1 to 4% by weight

Temperature: 325° C.

Pressure: 1000 psig $H_2$

Stirring Speed: 500–600 rpm

Run duration: 3 to 4 hours

B. Product Separation

Liquefaction samples taken at different times were extracted with benzene in a Soxhlet extraction apparatus. Percent conversion was obtained by the usual weight method and also from percent ash in benzene-insoluble residues. The benzene solution was then treated with pentane to separate pentane-insoluble asphaltenes. The pentane solution was subsequently vacuum distilled to obtain pentane, benzene, and light oil as distillates, with heavy oil as the bottom residue.

Results

A total of 23 runs were carried out under the experimental conditions described above.

Figure 3:
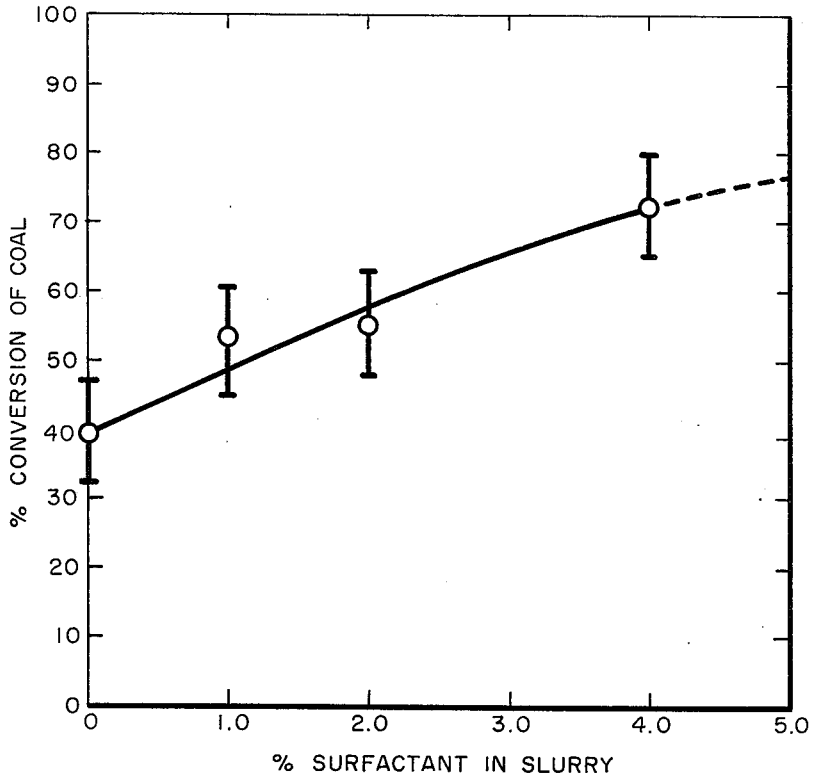
FIG. 3 is a graph showing the effect of surfactant on coal conversion.

A. Conversion Yield Results showed that without surfactant, the conversion to oil was around 40–50%; with surfactant, the conversion was increased to 70–80% for a coal slurry of 4 percent surfactant. FIG. 3 indicates an almost first order increase in conversion yield with respect to surfactant concentration, and suggests a positive effect of surfactant on coal liquefaction.

B. Product Distribution

Figure 4:
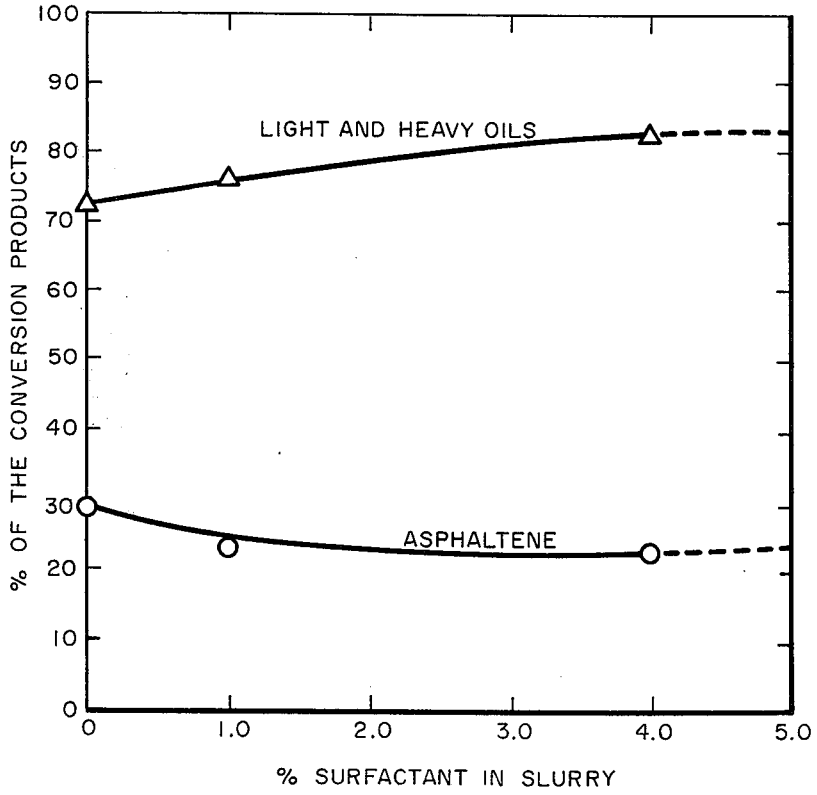
FIG. 4 is a graph showing the effect of surfactant on product distribution.

FIG. 4 shows the effect of surfactant on product distribution. With surfactant, the percent yield of light (M.W. 80–250; b.p.<150° C.) and heavy (M.W. 250–500; b.p. 150°–350° C.) oils together was higher and that of asphaltene (M.W. 500–1200) was accordingly lower. These data further suggest that the surfactant may also improve the quality of liquid products.

C. Kinetic Behavior

Figure 5:
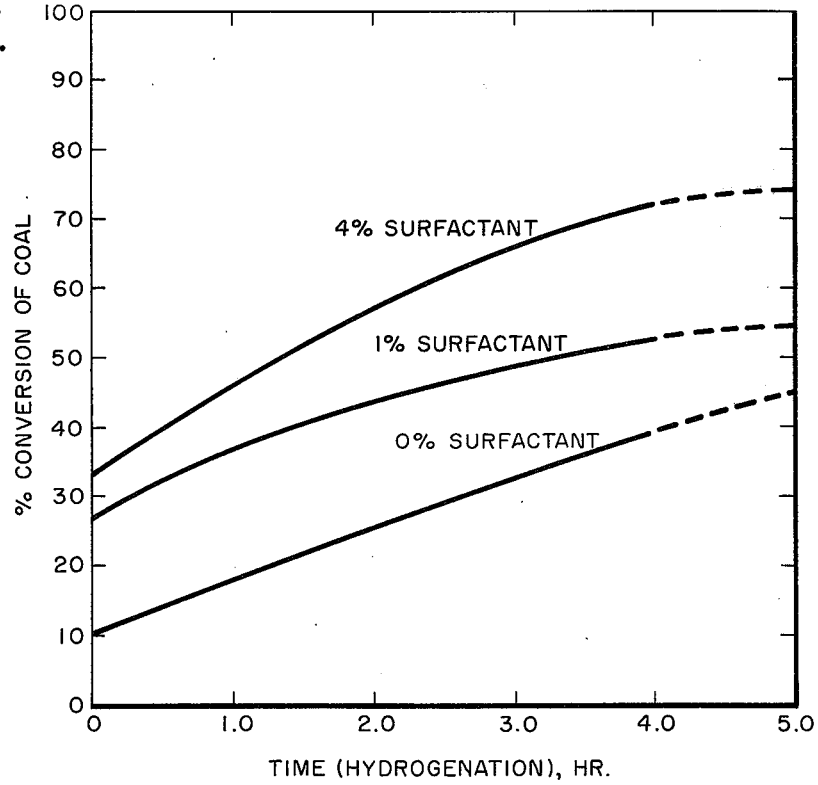
FIG. 5 is a graph showing the effect of surfactant on conversion rate.

The percent conversion of coal liquefaction versus time for different surfactant levels is illustrated in FIG. 5. In this case, "0 hour" stands for the time when the reactor temperature and hydrogen pressure have reached 325° C. and 1000 psig, respectively.

Process Considerations

A. Filtration

Since a surfactant usually has the effect of lowering the interfacial energy of a slurry system, mineral matter released from the dispersed coal particles may form a stable emulsion and thereby increases the filtration time. However, due to the reduced tendency toward agglomeration of asphaltenes in the presence of a surfactant, the slurry may become less viscous, thereby, facilitating the filtration process. In view of the above two competing phenomena, the following experiments were conducted to determine the filterability of surfactant-containing slurry.

1. Filtration Time

Figure 6:
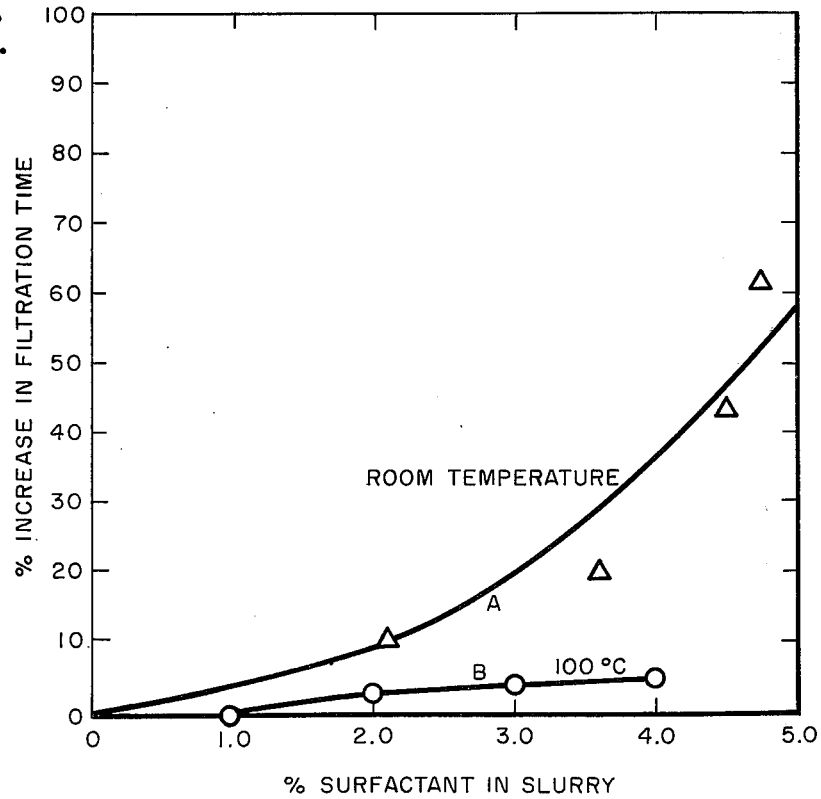
FIG. 6 is a graph showing the effect of surfactant on filtration time.

FIG. 6 shows the effects of surfactant on percent increase in filtration time. Curve A indicates the effect at room temperature using a 10 percent slurry of anthracene oil and benzene insoluble residue, and GF/A glass fiber filter. In this case, the addition of surfactant clearly prolongs the filtration time. On the other hand, curve B shows the effect at 100° C. using a liquefied coal slurry and a GF/B glass fiber filter. Negligible increase in filtration time was observed as: There was no increase in filtration time for 1% surfactant concentration; and a maximum of 4% increase in filtration time for a 4% surfactant concentration was noted. The effect of surfactant at 100° C. is considered much more meaningful as actual industrial filtration processes usually are operated at temperatures in excess of 100° C. Therefore, in an actual liquefaction process, there should not be any difficulty in filtration due to the presence of surfactants.

2. Surface tension and Viscosity

Surface tension of the liquefied coal slurry at 100° C. was 30.0 dynes/cm without surfactant, and it was reduced to 27.5 dynes/cm with 4% surfactant. Viscosity of the slurry at 100° C. was 28 centipoise, as measured by a Brookfield viscometer. It was reduced to 27 centipoise with 4% surfactant. These data point out that no solid separation problem due to surfactant is expected.

At 325° C., a 30% weight loss of surfactant occurs. The loss is resulted from thermal decomposition of the weak part of polymer due to temperature, and is not a function of time. In actual industrial operation, that 30% may have been taken out by a pretreatment step or the first processing cycle.

B. Other Experimental Analyses

Additional experiments were conducted to check the feasibility of recycling the surfactant. Polyflo-100 was mixed with anthracene oil, and heated at 325° C. for 4 hours. The heated solution was then used for subsequent liquefaction experiments for another 4 hours. 62% of the lignite was converted to oil and asphaltenes. This is compared to a 40% conversion obtained without surfactant. This positive effect suggests that the surfactant retains its effectiveness in enhancing lignite liquefaction in a recycle condition. This serves as a basis for an economical recycle of surfactant, and will be investigated further.

The commercial Polyflo-100 has about 2.2% nitrogen as amine groups. Wet chemistry analyses and IR showed that the thermally treated surfactant sample has a high nitrogen content of 2.8% as amines on a solvent-free basis. This indicates that most (>70%) of the amine groups are still there and certainly suggests the thermal survivability of amine groups in this polymer structure.

As to what form that surfactant is responsible for enhancing the liquefaction process, gel permeation chromatography analysis showed that the major peak with average molecular weight of 2170 in the original Polyflo-100 has been changed to a peak with average molecular weight 660 in the thermally-treated sample. The data suggests that the low-molecular-weight surfactants resulting from thermal treatment of Polyflo-100 may be responsible for enhancing the liquefaction. In this case, Polyflo-100 acts as a precursor. Using low-molecular-weight amine polymer to start with may serve as a more convenient way to introduce surfactant to the initial coal slurry. This broadens the scope for surfactant selection and optimization.

Polyflo-100 is known to be a surface active agent used as a petroleum dispersant/stabilizer in storage tanks. A significant decrease in percentage asphaltene yield in conversion products (18% versus 27%) with surfactant has also been observed. This supports the surfactant theory of preventing aggregation of asphaltenes. In addition, amine groups are known to be capable of preventing the association of hydrogen-bonding asphaltene micelles.

As to the related point that surfactant favors oil yields and thus upgrades the product distribution, the following additional data are presented:

TABLE 1.

Liquefaction Product Distribution Data

BASIS: 100 gms of LIGNITE

| EXPERIMENT | % CONVERSION | BENZENE INSOLUBLE RESIDUE (UNCONVERTED LIGNITE) | ASPHALTENE | HEAVY OIL | LIGHT OIL | GAS (EST.) |
|---|---|---|---|---|---|---|
| With 4% surfactant | 82% | 18.4 gm | 14.62 gm | 53.80 gm | 10.18 gm | 3.0 gm |
| Without surfactant | 49% | 51.0 gm | 13.05 gm | 31.50 gm | 3.45 gm | 1.0 gm |

This table shows that without surfactant 49% of lignite is converted to asphaltene, oil and gas. In the presence of 4% surfactant, the conversion is 82% and the increase in oil yield is quite significant. With surfactant the amount of oil is almost double of that obtained without surfactant (64 gm vs. 35 gm).

C. Economics

The proposed surfactant — aided liquefaction process may lead to a reduction in capital and operating costs due to the potential effects of surfactants on increasing throughput, and lowering temperature, pressure and hydrogen consumption. Moreover, this process does not require catalyst, and thus the cost of catalyst is saved.

Although the results to date are preliminary in nature, a rough estimate of the potential economic impact of using surfactants on coal liquefaction can be made as follows. The current price for the tested surfactant, polyflo-100, may range from $0.50 to 0.81 per pound depending upon the quantity purchased. Assuming a projected surfactant level of 1% with respect to coal, 45% conversion without surfactant and 75% conversion with surfactant under a given operating condition, 30% processing loss of surfactant and 3 barrels of oil produced for each ton of coal converted, the surfactant would cost $1.3/barrel of oil produced whereas the gain from the additional 30% conversion by using surfactant could amount to $8.0/barrel of oil produced, considering a projected coal conversion oil price of $20/barrel. This indicates a potential economic advantage of $6.7/barrel, from the point of view of surfactant-conversion trade-off, by using the surfactant in the described process. Furthermore, the processing loss of surfactant may be reduced by introducing a surfactant recovery treatment such as vacuum distillation, followed by pentane deasphaltene treatment and recycling the surfactant-rich stream back with the solvent oil. Also, more economical and improved surfactants may be identified from further investigation. Actual economic benefits can be more accurately estimated when a fuller understanding of the entire process technolgies and costs become available.

It is to be understood that only preferred embodiments of the invention have been described and that numerous substitutions, modifications and alterations are all permissible without departing from the spirit and scope of the invention as defined in the following claims:

What is claimed is:

1. In a method of liquefying a particulate, carbonaceous substance at high temperature and under hydrogen pressure in organic liquid reaction media to form a polar, partially hydrogenated asphaltene intermediate, the improvement comprising:

forming a suspension containing 5% to 50% by weight of the particulate substance suspended in organic liquid reaction media consisting essentially of a non-polar, organic solvent for the liquefied, asphaltene conversion products and 0.1% to 10% based on the substance of an oil soluble, organic surfactant having a molecular weight from 300 to 5,000 and containing from 1 to 15% by weight of a polar group;

heating the suspension to a temperature above 300° C.;

pressurizing the suspension with hydrogen at a pressure of at least 500 psi; and converting the particles to a liquid oil product.

2. A method according to claim 1 in which the substance is coal.

3. A method according to claim 2 in which the coal particles are from 60 to 325 mesh.

4. A method according to claim 3 in which the coal is lignite.

5. A method according to claim 2 in which the liquid media is an anthracene oil.

6. A method according to claim 3 in which the ratio of coal to liquid media is from 10% to 35%, the temperature is from 325° C. to 500° C., the hydrogen pressure is from 2000 to 4000 psi and the surfactant is present in an amount from 0.5% to 5% by weight.

7. A method according to claim 6 in which the surfactant has a long hydrocarbon chain portion to which is attached said amount of at least one polar group.

8. A method according to claim 1 in which the polar group is selected from amine, hydroxyl, carboxyl, sulfonic, phosphonic or thiophosphate.

9. A method according to claim 8 in which the surfactant is a long chain hydrocarbon amine having a molecular weight from 2,000 to 3,000 and a nitrogen content of from 1.5% to 3.5% by weight.

10. A method according to claim 9 in which the surfactant additionally contains from 0.5 to 3% oxygen by weight as hydroxyl groups.

11. A method according to claim 2 further including the steps of separating the liquid oil product from the suspension.

12. A method according to claim 11 further including the step of separation the liquid media and surfactant from the liquid oil product and recycling them to the suspension.

13. A composition of matter as a feed for a coal liquefaction reactor comprising a slurry of coal particles containing 5 to 50% by weight of coal suspended in organic liquid media consisting essentially of a non-polar, organic solvent for liquefied, polar partially hydrogenated asphaltene and 0.1% to 10% based on the coal of an oil-soluble surfactant consisting of a long hydrocarbon chain organic amine having a molecular weight from 300 to 5,000 and containing from 1.5% to 3.5% by weight of nitrogen and 0.5 to 3% oxygen by weight as hydroxyl groups.

14. A composition according to claim 13 in which the solvent is anthracene oil.

* * * * *